US005101168A

United States Patent [19]

Miller

[11] Patent Number: 5,101,168

[45] Date of Patent: Mar. 31, 1992

[54] HIGH EFFICIENCY HIGH POWER MICROWAVE SOURCE

[75] Inventor: Robert B. Miller, Albuquerque, N. Mex.

[73] Assignee: The Titan Corporation, San Diego, Calif.

[21] Appl. No.: 561,942

[22] Filed: Aug. 1, 1990

[51] Int. Cl.[5] ..... H01J 23/00

[52] U.S. Cl. ..... 328/233; 328/227; 328/232; 315/5.41

[58] Field of Search ..... 328/227, 232, 233; 315/5.18, 5.34, 5.41

[56] References Cited

U.S. PATENT DOCUMENTS 4,401,918 8/1983 Maschke ..... 315/5.34

*Primary Examiner*—Donald J. Yusko
*Assistant Examiner*—Diab Hamadi

[57] ABSTRACT

An electron gun emits a steady stream of electrons. The electrons pass to a modulating cavity which accelerates some of the electrons and decelerates other electrons in a particular timed relationship so that the electrons become periodically bunched. The bunched electrons are then accelerated in an accelerator to a constant speed such as the speed of light to maintain the bunching of the electrons and to substantially increase the energy of the electrons. The kinetic energy in the bunches of electrons is then converted to microwave energy. The conversion may occur in one output cavity or in a series of output cavities. Apparatus such as described above may be connected in parallel to further increase the output microwave energy.

26 Claims, 2 Drawing Sheets

FIG. 1
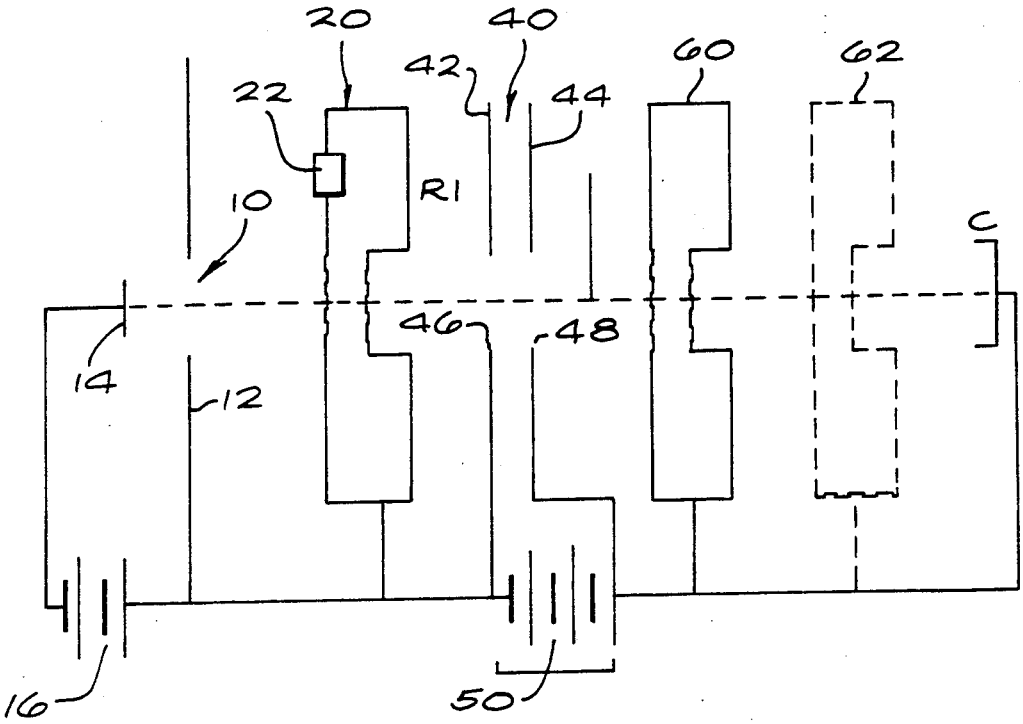
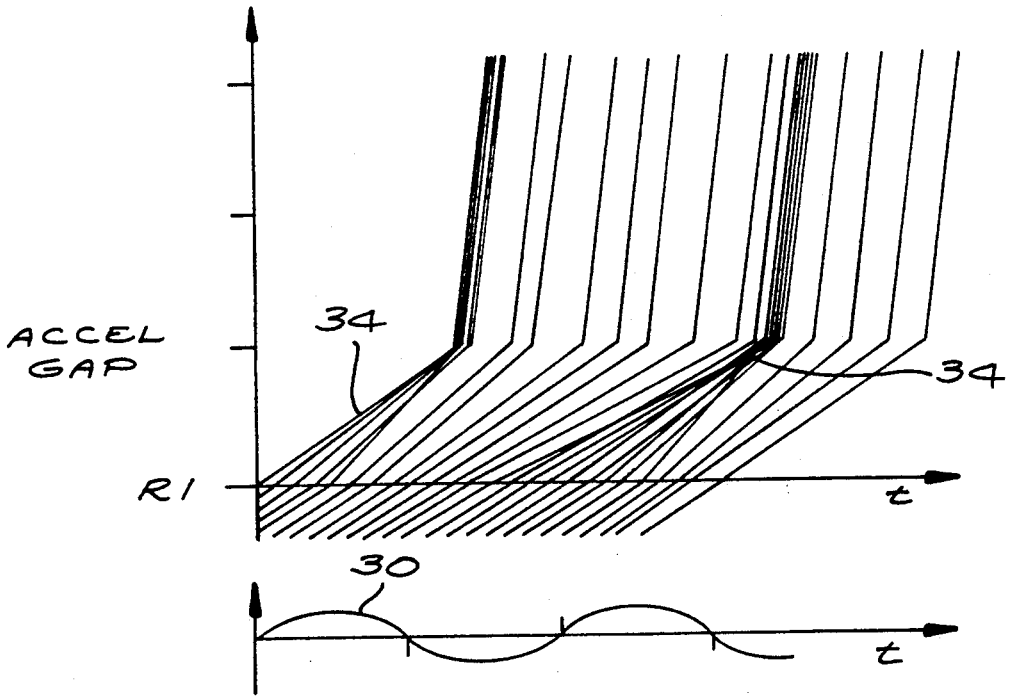
FIG. 2

HIGH EFFICIENCY HIGH POWER MICROWAVE SOURCE

BACKGROUND OF THE INVENTION

This invention relates to a system for generating microwave power of high magnitudes and at high efficiencies and of converting the kinetic energy of a modulated electron beam into microwave energy. More particularly, this invention relates to a system for bunching electrons and then increasing the energy of the electrons while maintaining the bunching of the electrons so that the energy periodically is of a high magnitude. The invention also relates to a method of generating microwave power of high magnitudes and at high efficiencies and of converting the electron beam kinetic energy into microwave energy.

Apparatus is now known and has been in use for several decades for producing microwave energy. Such apparatus includes klystrons and magnetrons. Such apparatus produces pulses of electrons which are then used to generate microwave energy. Some of these apparatuses operate with relatively high efficiencies (such as efficiencies above 50%) but their peak power is relatively low. Others of these apparatuses are capable of producing large amounts of power but their efficiencies are relatively low (such as 10%-20%). No apparatus is now in use which is capable of generating large amounts of microwave power (≧100 MW, for example) at high efficiencies (≧40%).

SUMMARY OF THE INVENTION

This invention provides apparatus which generates large amounts of microwave power at high efficiencies. Furthermore, the apparatus of this invention is capable of performing in this manner in a relatively small amount of space and with a relatively low weight. The apparatus is capable of producing the microwave energy at a particular frequency.

In one embodiment of the invention, an electron gun emits a steady stream of electrons. The electrons pass to a modulating cavity structure which accelerates some of the electrons and decelerates other electrons in a particular timed relationship so that the electrons become periodically bunched. The bunched electrons are then accelerated in an accelerator to a constant speed such as the speed of light to maintain the bunching of the electrons and to substantially increase the energy of the electrons. The kinetic energy in the bunches of electrons is then converted into microwave energy. The conversion may occur in one output cavity or in a series of output cavities, each of which is responsive only to a portion of the energy in the electrons. Apparatus such as described above may be connected in parallel to further increase the microwave energy output.

BRIEF DESCRIPTION OF THE DRAWING

In the drawings:

FIG. 1 is a schematic diagram of one embodiment of the invention for producing microwave energy with a high power and at a high efficiency;

FIG. 2 is a schematic diagram illustrating how certain components in the system shown in FIG. 1 operate to bunch electrons into periodic pulses.

DESCRIPTION OF THE PREFERRED EMBODIMENTS

Figure 3:
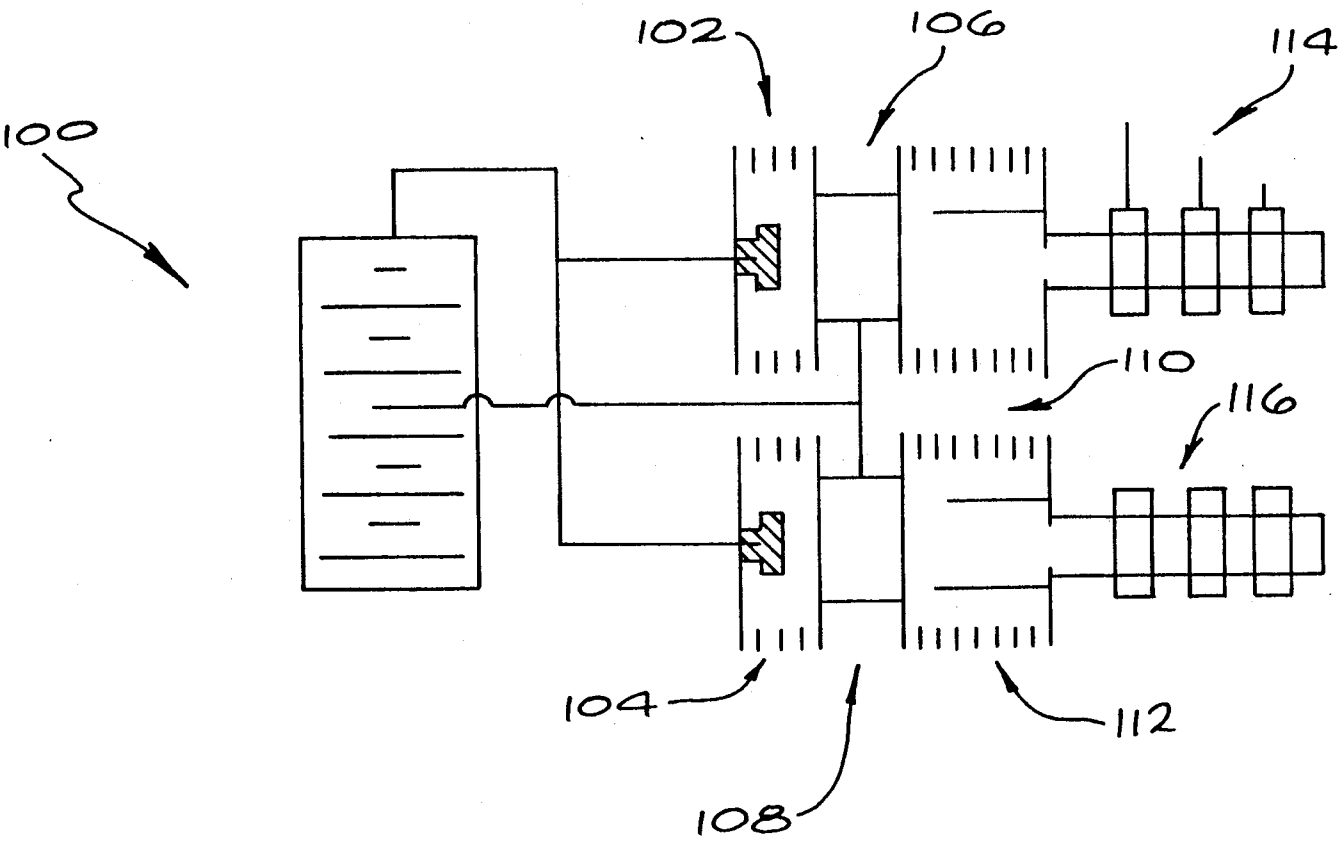
FIG. 3 is a schematic diagram of a second embodiment of the invention for increasing the production of the amount of microwave power and energy.

In one embodiment of the invention, an electron gun generally indicated at 10 includes an anode 12 and a cathode 14 which are connected to a suitable power source indicated schematically by a battery 16. As shown, the positive terminal of the battery 16 is connected to the anode 12 and the negative terminal of the battery 16 is connected to the cathode 14. This causes electrons to be emitted by the cathode 14 and to be attracted in a particular direction toward the anode 12. The electron gun 10 may be constructed in a conventional manner. By way of illustration, one hundred kilovolts (100 kv) may be applied to the electron gun 10 to produce a current of approximately one hundred amperes (100 A).

The electrons produced by the electron gun 10 pass to a resonator generally indicated at 20. The resonator 20 may be constructed in a conventional manner. It includes a radio frequency source 22 which produces a voltage across the resonator gap at a particular frequency. When the source 22 is positive, the electrons passing to the resonator are accelerated in the particular direction. Similarly, when the voltage from the source 22 is negative, the electrons passing to the resonator 20 are decelerated. This causes the electrons passing to the resonator 20 to become bunched in accordance with the recurrent characteristics of the voltage from the source 22. This is illustrated schematically in FIG. 2 which indicates at 30 the radio frequency signal from the source 22 and indicates at 34 the bunching of the electrons on a periodic basis in accordance with the periodic characteristics of the signal 30.

The bunching 34 of the electrons is optimal at the entrance to an accelerator generally indicated at 40. The accelerator 40 includes a pair of spaced walls 42 and 44 respectively having central openings 46 and 48. A potential difference is applied between the spaced walls 42 and 44 as indicated schematically by a battery 50, the negative terminal of which is connected to the wall 42 and the positive terminal of which is connected to the wall 44. By way of illustration, this voltage may be in the order of nine hundred kilovolts (900 KV).

The application of the voltage to the accelerator 40 causes the electrons passing to the accelerator to be accelerated in the particular direction so that they have a substantially constant speed such as the speed of light. Because they have a constant speed, their relative positions are maintained as they pass through and past the accelerator 40. This maintains the electrons in their bunched configuration as illustrated at 34 in FIG. 2. As will be appreciated, the energy of the electrons is considerably increased by the application of the accelerating voltage to the accelerator 40.

The energy represented by the electron stream passing through the accelerator 40 in the particular direction is converted into electromagnetic energy in an output cavity 60. The output cavity 60 is well known in the art. It may be that the amount of energy in the electrons passing from the accelerator 40 may be so large that all of such energy cannot be converted to electromagnetic energy in a single output cavity without causing electric field breakdown. Under such circumstances, additional output cavities such as a cavity 62 may be provided in series with the cavity 60 to convert additional portions of the energy in the electrons from the accelerator 40 into electromagnetic energy.

The additional cavities such as the cavity 62 may be considered to be in series with the cavity 60 because they are displaced in the particular direction from the cavity 60 on the downstream side from the cavity 60. The cavity 62 is shown in broken lines in FIG. 1 to indicate that it may be one or a plurality of cavities.

The amount of beam kinetic energy converted into electromagnetic energy may be increased by providing parallel arrangements of the apparatus constituting this invention. Such an arrangement is shown by way of illustration in FIG. 3. The embodiment shown in FIG. 3 includes a Marx generator generally indicated at 100 which is well known in the art to develop a relatively high voltage. The Marx generator 100 may be considered to comprise a plurality of capacitors which are charged in parallel and are discharged in series. The capacitors may become charged to produce a relatively high voltage such as a voltage in the order of five hundred kilovolts (500 KV) to one megavolt (1 MV) when they are discharged in series. Alternatively, the high voltage could also be produced by a high voltage pulse transformer.

The voltage in the Marx generator 100 is introduced to a pair of electron guns generally indicated at 102 and 104 each constructed in a manner similar to the electron gun 10. Each of the guns 102 and 104 is constructed to pass electrons in a particular direction such as a horizontal direction and is displaced from the other electron gun in a direction perpendicular to the particular direction. The electrons from the electron guns 102 and 104 then respectively pass in the particular direction to suitable stages such as high current modulating cavities generally indicated at 106 and 108 which produce beam bunching in a manner corresponding to that produced by the resonator 20 shown in FIG. 1. Such high current modulating cavities are well known in the art. Any other suitable modulating cavities can also be used. In one portion of the electromagnetic cycle, the electrons from the electron gun 100 may be accumulated in the cavity and then stopped. In a second portion of the electromagnetic cycle, the electrons in the cavity may be accelerated as a beam in the particular direction. In this way, bunches or pulses of electrons are produced.

The electrons respectively passing in the particular direction from the modulating cavities are received by accelerators, generally indicated at 110 and 112, corresponding in construction to the accelerator 40 in FIG. 1. The accelerators 110 and 112 accelerate the electrons to a constant speed such as the speed of light. As previously described, this tends to maintain the pulses or bunches of electrons "frozen" in a spaced relationship to one another. The kinetic energy in the electron bunches or pulses is then converted into electromagnetic energy by output coupling cavities generally indicated at 114 and 116. Each of the output cavities 114 and 116 may correspond in construction to the output cavities 60 and 62 in FIG. 1.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for providing kinetic energy of an electron beam and converting the kinetic energy of the electron beam into a different energy form than kinetic energy, first means for producing a stream of electrons in a particular direction at a particular speed, second means responsive to the stream of electrons from the first means for varying the speed of the electrons in the particular direction on a cyclic basis to produce bunches of the electrons in the particular direction, third means for accelerating the electrons in the particular direction to produce a particular speed for the electrons after the formation of the bunches of the electrons in the particular direction, and fourth means responsive to the electrons moving in the particular direction at the particular speed for converting the kinetic energy in such beam of electrons into the energy form different from such kinetic energy.

2. In a combination as set forth in claim 1, the fourth means including a plurality of means disposed at progressive positions in the particular direction, each of such progressively disposed means being constructed to convert a portion of the beam of kinetic energy in the electrons from the third means into the different energy form.

3. In a combination as set forth in claim 1, the second means including means for providing periodic accelerations and decelerations to the electrons in the particular direction.

4. In a combination as set forth in claim 3, the third means including means for applying an electrical field to the electrons in the particular direction to produce the particular speed for the electrons after the formation of the bunches of the electrons in the beam in the particular direction.

5. In combination for providing kinetic energy and converting the kinetic energy of the electron beam into a different energy form than kinetic energy, first means for producing an electrical field in a particular direction to produce a movement of electrons in the particular direction in a steady stream, second means for producing a variable electrical field in the particular direction to produce a bunching of the electrons in the particular direction, third means for accelerating the electrons in the particular direction, after the bunching of the electrons, to produce a movement of the electrons in the particular direction at a constant speed, and means for converting the kinetic energy in the bunches of electrons in the particular direction as a result of the movement of the bunches of electrons at the constant speed into the form energy different from such kinetic energy.

6. In a combination as set forth in claim 5, the second means including a modulating cavity structure for producing an electrical field and means for applying an alternating voltage to the modulating cavity structure to provide a variable electrical field in the particular direction.

7. In a combination as set forth in claim 5, the third means including means for creating an electrical field in the particular direction, after the bunching of the electrons, to produce a movement of the electrons in the particular direction at the speed of light while maintaining the bunching of the electrons.

8. In a combination as set forth in claim 5, the fourth means including at least one output cavity for converting the energy in the bunched electrons moving at the constant speed into electromagnetic energy.

9. In combination for providing kinetic energy of an electron beam and for converting the kinetic energy of the electron beam into a different energy form than kinetic energy, first means for providing an electrical voltage, second means responsive to the electrical voltage and defining an electron gun for creating a stream of electrons in a particular direction, third means responsive to the stream of electrons and defining a modulating structure for bunching the electrons in the stream in the particular direction, fourth means responsive to the bunched electrons for maintaining the spacing between the electrons in the stream, after the bunching of the electrons, during the stream of the electrons in the particular direction, and fifth means responsive to the movement of the electrons in the particular direction after the operation of the fourth means for converting the kinetic energy in the bunches of the electrons in the particular direction into the energy form different from such kinetic energy.

10. In a combination as set forth in claim 9, the third means including means for applying an alternating electrical field to the stream of electrons from the second means to obtain the bunching of the electrons in the stream in the particular direction.

11. In a combination as set forth in claim 9, the fourth means including means for applying an electrical field to the bunched electrons in the particular direction for accelerating the bunched electrons to a particular speed in the particular direction while maintaining the spacing between the bunched electrons in the stream.

12. In a combination as set forth in claim 9, the fifth means including at least one output cavity constructed to convert the kinetic energy in the bunched electrons in the particular direction into electromagnetic energy.

13. In a combination as set forth in claim 9, the third means including means for applying an alternating electrical field to the modulating structure to obtain the bunching of the electrons in the stream in the particular direction, the fourth means including means for applying an electrical field to the bunched electrons in the particular direction for accelerating the bunched electrons to substantially the speed of light in the particular direction while maintaining the spacing between the bunched electrons in the stream, and the fifth means including a plurality of output cavities in series, each of such cavities being constructed to convert a progressive portion of the energy in the stream of bunched electrons in the particular direction into the different energy form.

14. In combination for providing kinetic energy of an electron beam and for converting the kinetic energy of the electron beam into a different energy form than kinetic energy, means for providing a particular voltage, a pair of electron guns disposed in a parallel relationship, each of the electron guns being responsive to the particular voltage for producing a stream of electrons in a particular direction, a pair of modulating cavity means each associated with an individual one of the electron guns and constructed to bunch the electrons in the stream from the associated electron gun in the particular direction, a pair of accelerator means each associated with an individual one of the modulating cavities and constructed to accelerate the electrons from the associated one of the modulating cavity means to a particular speed in the particular direction, and at least a pair of output cavity means each associated with an individual one of the accelerator means and constructed to convert the kinetic energy in the electrons from the associated accelerator means into the energy form different from kinetic energy.

15. In a combination as set forth in claim 14, each of the electron guns including means for emitting electrons and means for producing an electrical field on the electrons in the particular direction to obtain a movement of the electrons in the stream in the particular direction.

16. In a combination as set forth in claim 14, each of the modulating cavity means including means for producing an electrical field on the electrons in the particular direction and means for varying the electrical field at a particular frequency to obtain the formation of the bunches of the electrons in the stream in the particular direction at the particular frequency.

17. In a combination as set forth in claim 14, each of the accelerator means including means for producing an electrical field on the electrons in the particular direction with a magnitude to produce a movement of the electrons at the speed of light while maintaining the bunching of the electrons.

18. In a combination as set forth in claim 14, each of the output cavity means including means for producing an electrical field on the electrons to convert the kinetic energy in the electrons in the particular direction into electromagnetic energy.

19. In a combination as set forth in claim 14, there being a plurality of output cavities in each of the output cavity means, the cavities in each of the output cavity means being disposed in series and each individual one of the cavities in each output cavity means being constructed to convert a progressive portion of the kinetic energy in the electrons from the associated accelerator means into electromagnetic energy.

20. In combination for providing kinetic energy of an electron beam and for converting the kinetic energy of the electron beam into a different energy form than kinetic energy, means for providing a particular voltage, first and second means disposed in a parallel relationship with the voltage means, each of the first and second means being constructed to produce a stream of electrons in a particular direction, third and fourth means respectively associated with the first and second means, each of the third and fourth means being constructed to receive the stream of electrons from the associated one of the first and second means and to bunch the electrons, fifth and sixth means respectively associated with the third and fourth means, each of the fifth and sixth means being constructed to accelerate the electrons from the associated one of the third and fourth means in the particular direction with continued movement of the electrons in the particular direction while retaining the bunching of such electrons, and seventh and eight means respectively associated with the fifth and sixth means, each of the seventh and eight means being constructed to convert the kinetic energy in the bunched electrons from the associated one of the fifth and sixth means into the different energy form.

21. In a combination as set forth in claim 20, each of the seventh and eight means including a plurality of means each constructed to convert a progressive portion of the kinetic energy in the bunched electrons from the associated one of the fifth and sixth means into the different energy form.

22. In a combination as set forth in claims 20, each of the fifth and sixth means being constructed to accelerate the electrons to a constant speed while maintaining the bunching of the electrons.

23. In a combination as set forth in claim 20, each of the seventh and eighth means including a plurality of means each constructed to convert a progressive portion of the kinetic energy in the bunched electrons from the associated one of the fifth and sixth means into electromagnetic energy, each of the fifth and sixth means being constructed to accelerate the electrons to a substantially constant speed while maintaining the bunching of the electrons.

24. A method of providing kinetic energy of an electron beam and converting the kinetic energy of the electron beam into a different energy form than kinetic energy, including the steps of:

providing a stream of electrons in a particular direction, bunching the electrons in the stream, accelerating the bunched electrons in the stream to a particular speed while maintaining the bunching of the electrons, and converting the kinetic energy in the bunches of electrons at the particular speed into the different energy form.

25. A method as set forth in claim 24 wherein the bunched electrons in the stream are accelerated to substantially the speed of light while maintaining the bunching of the electrons.

26. A method as set forth in claim 25 wherein the kinetic energy in the bunches of the electrons at substantially the speed of light is converted to electromagnetic energy.

* * * * *